US005230446A

United States Patent [19]

Vaida

[11] Patent Number: 5,230,446

[45] Date of Patent: Jul. 27, 1993

[54] SQUEEZABLE AND REFILLABLE CONTAINER FOR DISPENSING LIQUID SOAP

[76] Inventor: George Vaida, Canada L-4, Alturas del Remanso, Rio Piedras, P.R. 00926

[21] Appl. No.: 792,680

[22] Filed: Nov. 15, 1991

[51] Int. Cl.[5] ..... B65D 37/00

[52] U.S. Cl. ..... 222/215; 220/676; 222/565

[58] Field of Search ..... 222/206, 215, 565; 206/77.1, 524.6; 220/676; 215/270

[56] References Cited

U.S. PATENT DOCUMENTS

| | | | |
|---|---|---|---|
| 2,578,864 | 12/1951 | Tupper | 222/215 |
| 3,319,838 | 5/1967 | Bayles et al. | 222/215 |
| 3,339,809 | 9/1967 | Church et al. | 222/215 |
| 3,913,808 | 10/1975 | Hill | 222/565 |
| 4,820,435 | 4/1989 | Zafiroglu | 206/0.5 X |

*Primary Examiner*—Andres Kashnikow
*Assistant Examiner*—Joseph A. Kaufman
*Attorney, Agent, or Firm*—Ezra Sutton

[57] ABSTRACT

A soft plastic container for dispensing liquid soap through a permeable and porous wall of the container, wherein the outer surface of the permeable wall forms a scrubbing surface. A closure is provided for refilling the container with liquid soap so it may be reused.

13 Claims, 3 Drawing Sheets

SQUEEZABLE AND REFILLABLE CONTAINER FOR DISPENSING LIQUID SOAP

FIELD OF THE INVENTION

The present invention relates to a squeezable container having at least one porous wall for dispensing liquid soap when squeezed and a device for refilling said container with liquid soap to allow it to be reused.

BACKGROUND OF THE INVENTION

Containers for dispensing liquid soap are known in the prior art and include walls having a permeable material with a sufficient porosity to dispense liquid soap, such as disclosed in U.S. Pat. No. 4,820,435. However, such prior art containers are not refillable and reusable and thus must be disposed of after only a single use.

It is an object of the present invention to provide a liquid soap dispenser which has at least one porous wall for dispensing liquid soap, is squeezable, includes at least one scrubbing surface, and is refillable and reusable.

SUMMARY OF THE PRESENT INVENTION

In accordance with the principles of the present invention, there is provided a squeezable container for dispensing liquid soap, which preferably is in the shape of a bar of soap, and includes a device for refilling the container with liquid soap.

At least one of the walls of the container is permeable and has a porosity for allowing the liquid soap to be dispensed only when a squeezing pressure is applied to the container. The outer surface of the permeable wall forms a scrubbing surface for cleaning one's body or any other surfaces.

Preferably, the container is molded, and the walls of the container are formed of high density polyethylene or polypropylene, have a thickness of ⅛", and an average mean pore size of 15 to 40 microns.

BRIEF DESCRIPTION OF THE DRAWINGS

Further objects, features, and advantages of the present invention will become apparent upon consideration of the detailed description of the presently-preferred embodiment, when taken in conjunction with the accompanying drawings wherein.

DETAILED DESCRIPTION OF THE PREFERRED EMBODIMENTS

Figure 1:
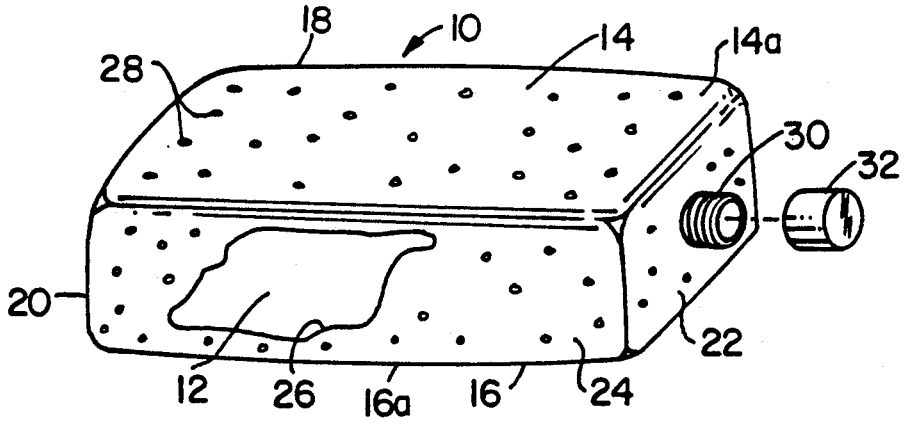
FIG. 1 is a perspective view of one embodiment of the container of the present invention.

As shown in FIG. 1, there is a container 10 for dispensing liquid soap 12 molded in a plastic material. The container 10 is shown in the shape of a bar of soap, but the container 10 may be of any other desired shape. The container 10 includes upper wall 14, lower wall 16, and side walls 18, 20, 22, and 24. The walls define an internal chamber 26 for holding the liquid soap 12.

At least upper wall 14 is formed of a permeable material, and preferably is a nonwoven porous material, such as high-density polyethylene or polypropylene. The outer surface 14*a* of permeable wall 14 forms a scrubbing surface for cleaning. In another embodiment, lower wall 16 is also permeable, and its outer surface 16*a* forms a scrubbing surface. In still another embodiment, all the walls are permeable and form outer scrubbing surfaces.

In the preferred embodiment, the permeable walls 14 and 16 are high-density polyethylene (HDPE) sold by Porex Technologies of Fairburn, Ga. The dispensing pores or holes are shown at 28, and the preferred pore size is 15 to 40 microns but can be in the range of 10 to 150 microns. The preferred range of pore volume is 40% to 50% but can be changed, if desired. The thickness of the permeable walls is preferably ⅛" but can be in the range of 1/16" to ¼".

The outer surfaces 14*a* and 16*a* cannot be too abrasive to the skin and preferably are of the fine or extra fine grade sold by Porex. Of course, other similar or equivalent materials may be employed within the scope of the invention.

The squeezing pressure to be applied to container 10 to dispense the liquid soap 12 from internal chamber 26 through the permeable walls 14 and 16 varies with the pore size, the material, the thickness of the material, surface characteristics, and the viscosity of the liquid soap. Ivory liquid soap has a suitable viscosity for the pore size and thickness of the preferred embodiment. The squeezing pressure to dispense the liquid soap 12 can be as low as 0.2 PSI but preferably is in the range of 1 PSI to 10 PSI. When no pressure is applied to the container, the porosity is such that no liquid will be dispensed or seep through the permeable walls of the container 10. Thus, the container has a long shelf life.

After all or part of the liquid soap 12 has been dispensed and used, the container 10 may be refilled and reused. As shown in FIG. 1, the container 10 includes a passageway 30 through side wall 22 and into internal chamber 26, and a removable filler cap 32 which is screwed on for closing passageway 30 after the internal chamber 26 is refilled. To fill chamber 26, the liquid soap 12 may be poured or squeezed through passageway 30.

Alternatively, a one-way recessed, plastic, check valve may be placed in passageway 30 to allow liquid soap 12 to pass into, but not out of, internal chamber 26. In such an embodiment, the soft filler cap 32 is optional.

Figure 2:
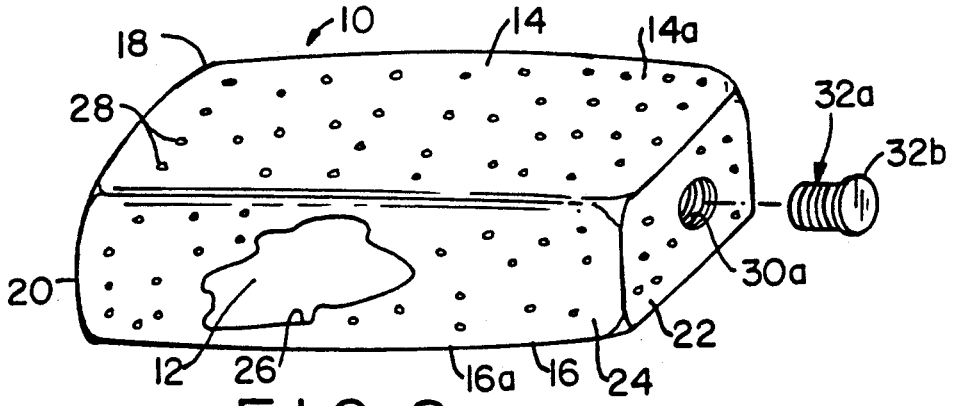
FIG. 2 shows an alternative closure.

FIG. 2 shows an alternative closure, wherein passageway 30*a* is recessed into the container, and cap 32*a* is a flush, molded cap having a flush head 32*b*.

Figure 3:
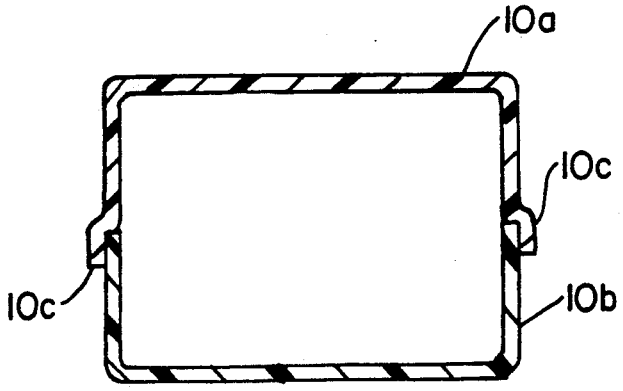
FIG. 3 is a cross-sectional view of another embodiment.

FIG. 3 illustrates an alternative method of making the container, wherein upper container section 10*a* is molded separately from lower container section 10*b*, and the two sections are heat sealed or glued along a seam 10*c* to form the container.

Figure 4:
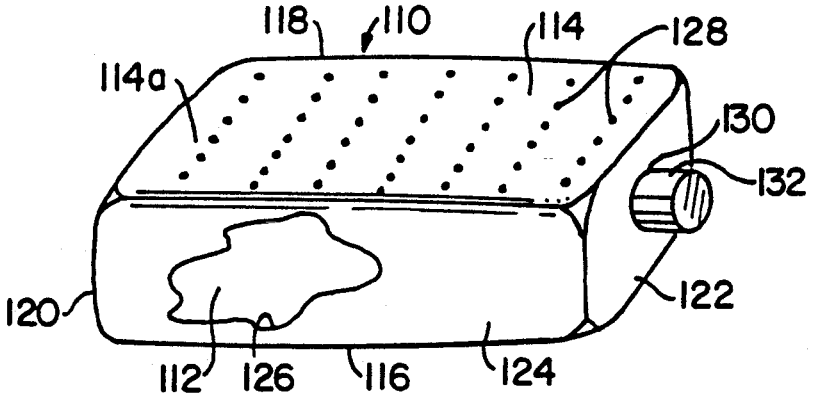
FIG. 4 is a perspective view of another embodiment.
Figure 5:
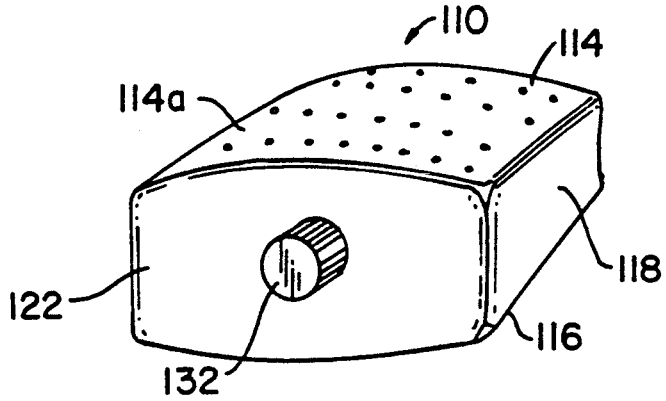
FIG. 5 is another perspective view of the embodiment of FIG. 4.
Figure 6:
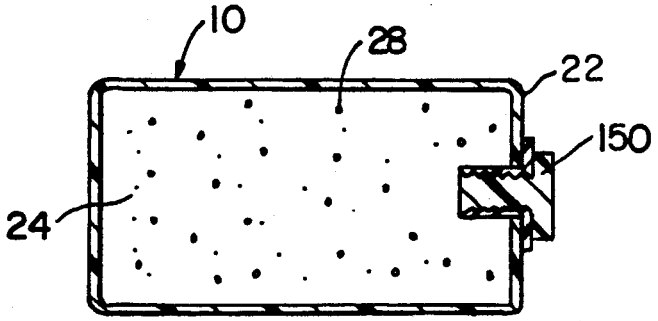
FIG. 6 shows an alternative closure.

FIGS. 4 and 5 show another embodiment of the invention. Container 110 has walls 114, 116, 118, 120, 122, and 124 which define an internal chamber 126 for holding the liquid soap 112. Container 110 is molded from a soft plastic material, such as polyethylene or polylpropylene. Dispensing holes or pores 128 are molded into container wall 114 or punctured into wall 114. Outer surface 114*a* forms a scrubbing surface, and it is pressed against the body with a squeezing pressure applied to container 110 to dispense the liquid soap 112 from internal chamber 126 through dispensing pores or holes 128. When not in use, the porous wall 114 faces upwardly to help prevent the liquid soap 112 from seeping out.

In addition, a soft closing cap 132 with internal threads is employed to close passageway 130 after the internal chamber 126 is refilled. The dimensions discussed above are also applicable to this embodiment.

FIGS. 6 to 10 show the embodiment of FIG. 1, except that alternative closures are illustrated in side wall 22. For example, in FIG. 6, a plastic insert 150 having threads is molded into the wall 22 of container 10. The plastic insert 150, on its interior, may be heat sealed or glued to the wall 22 of the container.

Figure 7:
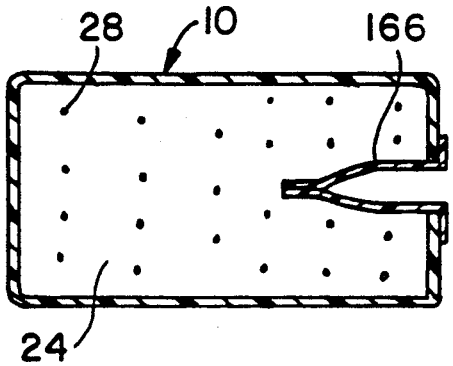
FIGS. 7, 8, and 9 show still another type of closure.
Figure 8:
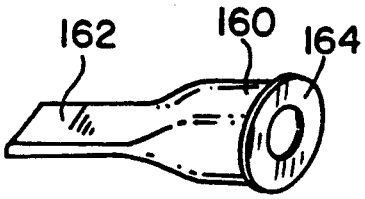
Figure 9:
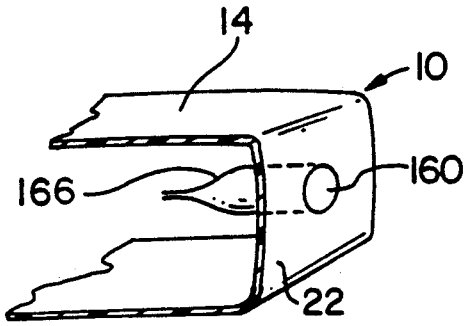

In FIGS. 7, 8, and 9, a plastic tube 160 is flattened at 162 and has a flange 164 and acts as a check valve to seal passageway 166. The flange 164 is glued or heat sealed to the wall 22 of the container.

Figure 10:
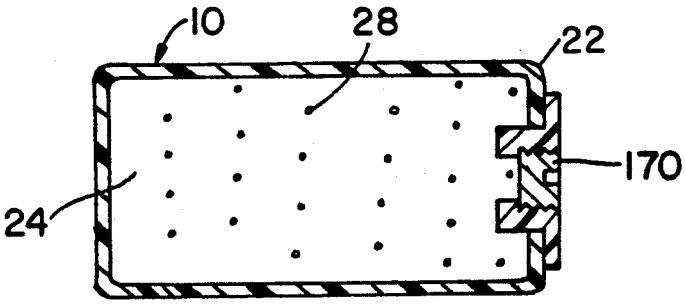
FIG. 10 shows an alternative closure for the container.

In FIG. 10, a screw cap 170 is shown for closing passageway 30. It is flush with wall 22 and is threaded with a recessed seat, and it is heat sealed or glued to wall 22.

Alternatively, a removable cork may be press-fit into the passageway 30*a* shown in FIG. 2 for refilling chamber 26.

Advantageously, in accordance with the present invention, there has been provided a unique squeezable container for dispensing liquid soap, which is refillable and reusable, has a removable closure, and includes one or more scrubbing surfaces.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope and of the invention herein.

What is claimed is:

1. A squeezable container for dispensing liquid soap, comprising:

a) a plurality of walls simulating the shape of a bar of soap;

b) said walls defining an internal chamber for containing the liquid soap to be dispensed;

c) one of said walls including closure means for opening and closing said container and for refilling said internal chamber with said liquid soap, wherein said closure means includes a one-way valve which allows liquid soap to pass into said internal chamber but not out of said internal chamber;

d) at least one of said walls being formed of a permeable material to allow said liquid soap to be dispensed from said internal chamber through said permeable wall when a squeezing pressure is applied to said container;

e) said permeable wall having a porosity which allows said liquid soap to pass through said permeable wall only when a squeezing pressure is applied to said container; and f) said permeable wall having an outer surface forming a scrubbing surface for cleaning.

2. A container in accordance with claim 1, wherein said permeable wall is formed of a non-woven porous material.

3. A container in accordance with claim 2, wherein said porous material has a pore size in the range of 10 to 150 microns.

4. A container in accordance with claim 2, wherein said porous material has an average mean pore size in the range of 15 to 40 microns.

5. A container in accordance with claim 1 wherein said liquid soap has a viscosity in the range of 10,000 to 40,000 centipoise.

6. A container in accordance with claim 1, wherein said closure means for refilling said internal chamber includes a passageway through said wall to said internal chamber and means for opening and closing said passageway to allow said internal chamber to be refilled with liquid soap.

7. A container in accordance with claim 1, wherein said permeable wall has a thickness in the range of 1/16" to ¼".

8. A container in accordance with claim 1, wherein said permeable wall has a thickness of ⅛".

9. A container in accordance with claim 1, wherein said permeable wall is formed of high-density polyethylene (HDPE).

10. A container in accordance with claim 1, wherein said permeable wall has a pore volume in the range of 40% to 50% of said permeable wall.

11. A container in accordance with claim 1, wherein said squeezing pressure to dispense said liquid soap is in the range of 0.2 PSI to 14 PSI.

12. A container in accordance with claim 1, wherein two opposite walls of said container are formed of a permeable material and the outer surfaces form scrubbing surfaces for cleaning.

13. A container in accordance with claim 12, wherein said scrubbing surfaces are abrasive for cleaning skin with said liquid soap.

* * * * *